US006878910B2

(12) United States Patent
Kim et al.

(10) Patent No.: US 6,878,910 B2
(45) Date of Patent: Apr. 12, 2005

(54) MICROWAVE OVEN HAVING STEAM VENT HOLE

(75) Inventors: Hyang-Ki Kim, Suwon (KR); In Ki Jeon, Suwon (KR); Sung Kwang Kim, Ansan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 18 days.

(21) Appl. No.: 10/418,045

(22) Filed: Apr. 18, 2003

(65) Prior Publication Data

US 2004/0094542 A1 May 20, 2004

(30) Foreign Application Priority Data

Nov. 15, 2002 (KR) ..... 10-2002-0071249

(51) Int. Cl.[7] ..... H05B 6/80

(52) U.S. Cl. ..... 219/682; 219/731; 219/757; 219/401

(58) Field of Search ..... 219/682, 707, 219/731, 757, 401, 702; 126/21 A

(56) References Cited

U.S. PATENT DOCUMENTS 4,454,404 A * 6/1984 Zushi ..... 219/682

FOREIGN PATENT DOCUMENTS

| | | | |
|---|---|---|---|
| JP | 54-136446 | * 10/1979 | ..... 219/682 |
| JP | 2-199789 | * 8/1990 | ..... 219/757 |
| JP | 6-249445 | * 9/1994 | ..... 219/707 |

OTHER PUBLICATIONS

Yasumichi et al., Cooker, published on Dec. 26, 2001, Abstract Only, Publication No. 2001–355843, Japan.

* cited by examiner

*Primary Examiner*—Philip H. Leung
(74) *Attorney, Agent, or Firm*—Staas & Halsey LLP

(57) ABSTRACT

A microwave oven includes a body which defines an appearance of the microwave oven, a cooking cavity provided therein, a microwave-supplying unit which generates microwaves to irradiate the microwaves into the cooking cavity, a plurality of vent holes which are formed on a sidewall of the cooking cavity to ventilate the cooking cavity, a water collecting depression which is formed on a bottom of the cooking cavity to contain water therein to generate steam, and a vent hole control unit which selectively closes the vent holes. During a steam cleaning operation of the microwave oven, the vent holes are closed to prevent a leakage of the steam from the cooking cavity to the outside of the microwave oven.

11 Claims, 10 Drawing Sheets

MICROWAVE OVEN HAVING STEAM VENT HOLE

CROSS-REFERENCE TO RELATED APPLICATIONS

This application claims the benefit of Korean Application No. 2002-71249, filed Nov. 15, 2002, in the Korean Intellectual Property Office, the disclosure of which is incorporated herein by reference.

BACKGROUND OF THE INVENTION

1. Field of the Invention

The present invention relates to microwave ovens, and more particularly, to a microwave oven having a cleaning device which generates steam to clean an interior surface of a cooking cavity, and a control method of cleaning the interior surface of the cooking cavity using the cleaning device.

2. Description of the Related Art

Generally, a microwave oven is an electrically operated oven which heats and/or cooks food laid in a cooking cavity thereof using high-frequency electromagnetic waves radiated from a magnetron into the cooking cavity. Unlike other types of electrically operated ovens, which heat the surface of food to cook the food, the microwave oven cooks food through a dielectric heating method where an interior of the food is heated. That is, during an operation of the microwave oven, the high-frequency electromagnetic waves, so-called "microwaves", are radiated from the magnetron into the cooking cavity, and penetrate the food so as to repeatedly change the molecular arrangement of moisture laden in the food. Accordingly, the microwaves cause the molecules of the moisture to vibrate and generate a frictional heat within the food to cook the food.

During a cooking operation of the microwave oven, the food laden with the moisture may sputter and fly in all directions, thus being stuck to an interior surface of the cooking cavity to contaminate the interior surface. Thus, a user must periodically clean the interior surface of the cooking cavity to maintain a clean state of the cooking cavity. Furthermore, the dispersed food pieces which are stuck to the interior surface of the cooking cavity may be encrusted thereon, making it difficult to remove the food pieces from the inner surface of the cooking cavity. Therefore, the user may spend time consuming efforts to clean the interior surface of the cooking cavity.

SUMMARY OF THE INVENTION

Accordingly, it is an aspect of the present invention to provide a microwave oven having a cleaning device which cleans an interior surface of a cooking cavity, and a control method of cleaning the interior surface of the cooking cavity using the cleaning device.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a body which defines an appearance of the microwave oven, a cooking cavity which is provided in the body, a microwave-supplying unit which generates microwaves to irradiate the microwaves into the cooking cavity, a vent hole which is formed on a wall of the cooking cavity to ventilate the cooking cavity, a water collecting depression which is formed inside the cooking cavity and receives water therein to generate steam, and a vent hole control unit which closes the vent hole to control a leakage of the steam from the cooking cavity during an operation of the microwave-supplying unit.

The vent hole control unit may include a cover which closes the vent hole and is provided at a position outside the cooking cavity, a support shaft which rotatably supports the cover, and a drive motor which rotates the support shaft in opposite directions.

The microwave oven may further comprise a vent hole sensor which is provided at a position corresponding to the vent hole and senses whether the cover closed the vent holes.

The microwave oven may further comprise a cooking tray which is rotatably installed in the cooking cavity and supports food thereon.

The microwave oven may further comprise a lighting unit which is provided at a predetermined area of the cooking cavity and lights the cooking cavity.

The microwave oven may further comprise a machine room which is defined in the body, separately from the cooking cavity, wherein the microwave-supplying unit is provided in the machine room, and a cooling fan which is provided at a predetermined area of the machine room, cools the microwave-supplying unit and ventilates the cooking cavity.

To achieve the above and/or other aspects of the present invention, there is provided another microwave oven comprising a body which defines an appearance of the microwave oven, a cooking cavity which is provided in the body, a microwave-supplying unit which generates microwaves to irradiate the microwaves into the cooking cavity, a vent hole which is formed on a wall of the cooking cavity to ventilate the cooking cavity, and a steam-generating vessel which is mounted on an interior surface of the wall of the cooking cavity so as to cover the vent hole, transmits the microwaves, and receives water therein to generate steam.

The steam-generating vessel may be inclined at an open top thereof at a predetermined angle of inclination so as to improve a supply of the steam into the cooking cavity.

A magnet may be mounted to a rear wall of the steam-generating vessel, so as to detachably attach the steam-generating vessel to the interior surface of the wall of the cooking cavity corresponding to the vent hole.

A locking hook may be formed on the steam-generating vessel, and a locking hole may be formed on the wall of the cooking cavity so as to engage with the locking hook and detachably attach the steam-generating vessel to the interior surface of the wall of the cooking cavity.

The steam-generating vessel may have a surface area that is larger than an area of the vent hole, so as to cover and close the vent hole.

The microwave oven may further include a vent hole sensor which senses whether the steam-generating vessel is attached to the wall of the cooking cavity to close the vent hole, and an alarm unit which reports a sensing result of the vent hole sensor.

To achieve the above and/or other aspects of the present invention, there is provided a control method of cleaning a microwave oven having a cooking cavity which includes a vent hole and a microwave-supplying unit, the method comprising closing the vent hole of the cooking cavity in response to a cleaning key signal, operating the microwave-supplying unit in response to the vent hole being closed and heating water fed into the cooking cavity for a predetermined period of time to generate steam in the cooking cavity, and maintaining a pause for a set time after stopping the operation of the microwave-supplying unit to generate the steam.

The closing of the vent hole in response to the cleaning key signal may include determining whether the vent hole is closed, and operating a vent hole control unit of the microwave oven to close the vent hole in response to the vent hole being opened.

In the method, the operating of the microwave-supplying unit may be maintained for three minutes.

In the method, the pause may be maintained for seven minutes after the operating of the microwave-supplying unit.

The method may further comprise indicating a completion of the control method after maintaining the pause for the set time.

The method may further comprise operating both a cooling fan of the microwave oven and a cooking tray installed in the cooking cavity during the operating of the microwave-supplying unit.

To achieve the above and/or other aspects of the present invention, there is provided another control method of cleaning a microwave oven having a cooking cavity which includes a vent hole, a microwave-supplying unit, and a steam-generating vessel to receive water, the method comprising operating the microwave-supplying unit, while closing the vent hole of the cooking cavity by using the steam-generating vessel, to heat the water fed into the steam-generating vessel for a predetermined period of time so as to generate steam in the cooking cavity, and maintaining a pause for a set time after stopping the operation of the microwave-supplying unit.

The operating of the microwave-supplying unit may comprise determining whether a cleaning key signal is input, determining whether the steam-generating vessel closes the vent hole in response to the cleaning key signal being input, alerting an open state of the vent hole in response to the vent hole being opened, and operating the microwave-supplying unit to heat the water in the steam-generating vessel, so as to generate the steam in the cooking cavity in response to the vent hole being closed.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
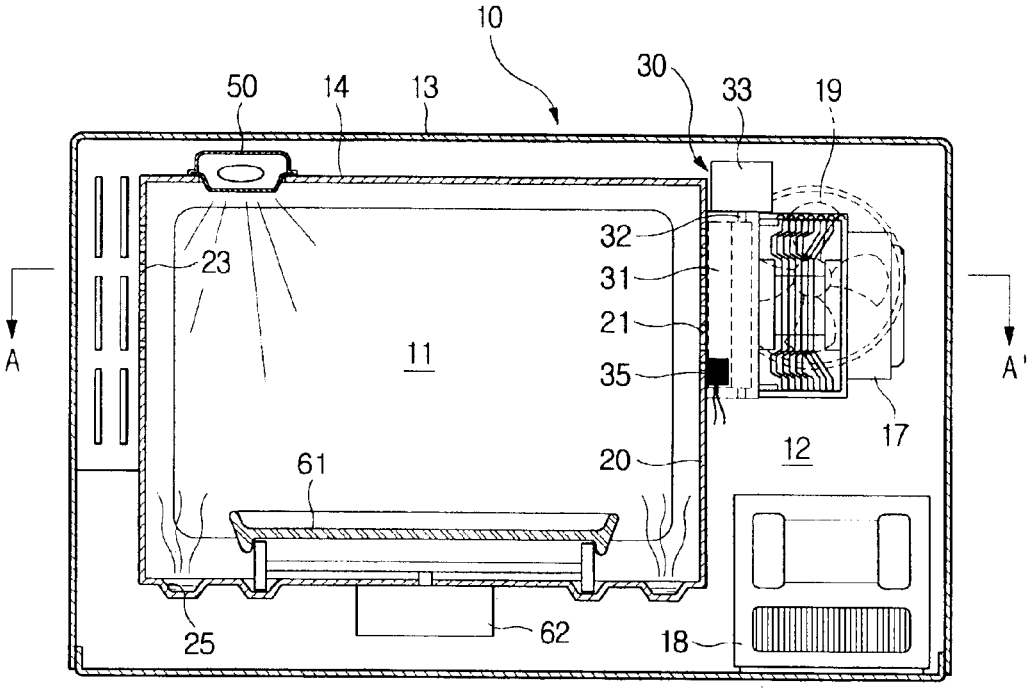
FIG. 1 is a sectional view of a microwave oven according to an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

FIGS. 1 to 4 illustrate a microwave oven according to an embodiment of the present invention. As shown in the drawings, the microwave oven includes a body 10 having a cooking cavity 11 and a machine room 12 which are separately defined therein. The cooking cavity 11 receives food to be cooked therein and the machine room 12 receives a variety of electrical elements of the microwave oven. An inner casing 14 of the microwave oven which defines the cooking cavity 11 is placed inside an outer casing 13 of the microwave oven, so as to divide an interior of the body 10 into the cooking cavity 11 and the machine room 12.

A cooking tray 61 is rotatably installed at a bottom of the cooking cavity 11, and supports food to be cooked by microwaves generated from a magnetron 17. A motor 62 is mounted at a position under the bottom of the cooking cavity 11, that is, a position under a bottom of the inner casing 14, and rotates the cooking tray 61. A lighting unit 50 is installed at an upper portion of the cooking cavity 11, and lights the interior of the cooking cavity 11 during, for example, a cooking operation.

Figure 2:
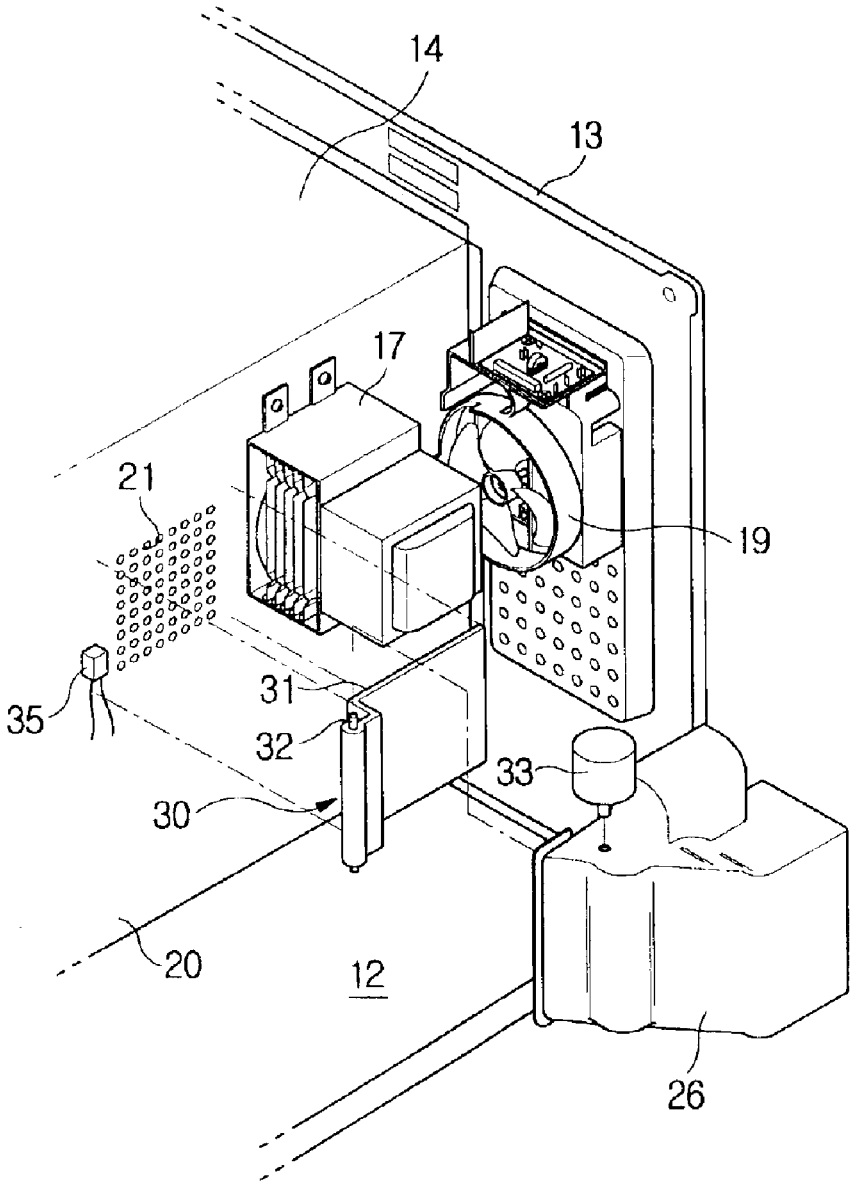
FIG. 2 is a partial perspective view showing the construction of a machine room of the microwave oven shown in FIG. 1.

As shown in FIGS. 1 and 2, the electrical elements installed in the machine room 12 include the magnetron 17 which irradiates the microwaves into the cooking cavity 11, and a high voltage transformer 18 which applies a high voltage to the magnetron 17. A cooling fan 19 is installed at a rear portion inside the machine room 12 so as to suck outside air into the machine room 12 to cool the electrical elements inside the machine room 12.

A sidewall 20 of the cooking cavity 11, which separates the cooking cavity 11 from the machine room 12, is provided with a plurality of first vent holes 21 to feed the air sucked into the machine room 12, using a suction force of the cooling fan 19, into the cooking cavity 11. A plurality of second vent holes 23 are formed at another sidewall of the cooking cavity 11, opposite to the sidewall having the first vent holes 21, so as to discharge the air from the cooking cavity 11 to the outside of the microwave oven. During an operation of the microwave oven, the outside air is sucked into the machine room 12 by the suction force of the cooling fan 19, thus cooling the electrical elements of the machine room 12. Thereafter, the air is introduced into the cooking cavity 11 through the first vent holes 21 to ventilate the cooking cavity 11, and discharged from the cooking cavity 11 to the outside through the second vent holes 23.

To allow a user to easily clean the interior surface of the cooking cavity 11, the microwave oven is provided with a cleaning device which includes a water collecting depression 25 and a vent hole control unit 30. The water collecting depression 25 is formed on, for example, the bottom of the cooking cavity 11 around the cooking tray 61 so as to have an annular profile and a predetermined depth. The vent hole control unit 30 selectively opens or closes the first vent holes 21.

To clean the interior of the cooking cavity 11, the user may feed a predetermined amount of water to the water collecting depression 25 formed on the bottom of the cooking cavity 11, so as to generate steam upon heating of the water during a cleaning control operation of the microwave oven, as will be described later herein. The vent hole control unit 30 closes the first vent holes 21 during the cleaning control operation so as to minimize a leakage of the steam from the cooking cavity 11 to the outside of the microwave oven.

As shown in FIG. 2, the vent hole control unit 30 closes the first vent holes 21 at a position inside the machine room 12, that is, a position outside the cooking cavity 11. The vent hole control unit 30 includes a cover 31 and a drive motor 33. The cover 31 is hinged by a support shaft 32 in an air guide duct 26, which is installed in the machine room 12 to guide air to the first vent holes 21. The drive motor 33 is exteriorly mounted to the air guide duct 26 at a predetermined position and rotates the support shaft 32 of the cover 31 in opposite directions.

The cover 31 has a surface area that is larger than an area of the entire first vent holes 21, so as to have the cover 31 completely cover and close the first vent holes 21 where the motor 33 rotates the cover 31 to close the first vent holes 21. A vent hole sensor 35 is provided on the sidewall 20 of the cooking cavity 11 at a position where the vent hole sensor 35 comes into contact with the closed cover 31. The vent hole sensor 35 senses a closed state or an open state of the cover 31 and may be realized through a micro-switch or an optical switch.

Figure 3:
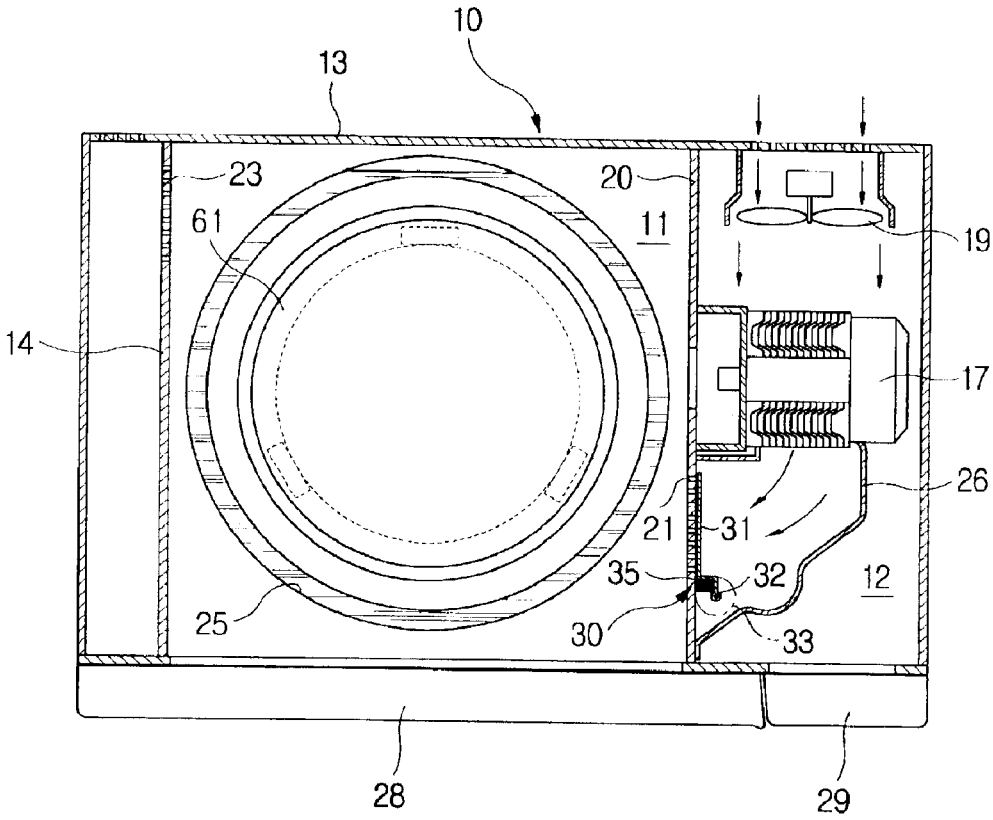
FIG. 3 is a sectional view taken along the line A–A' of FIG. 1, showing a closed state of first vent holes.
Figure 5:
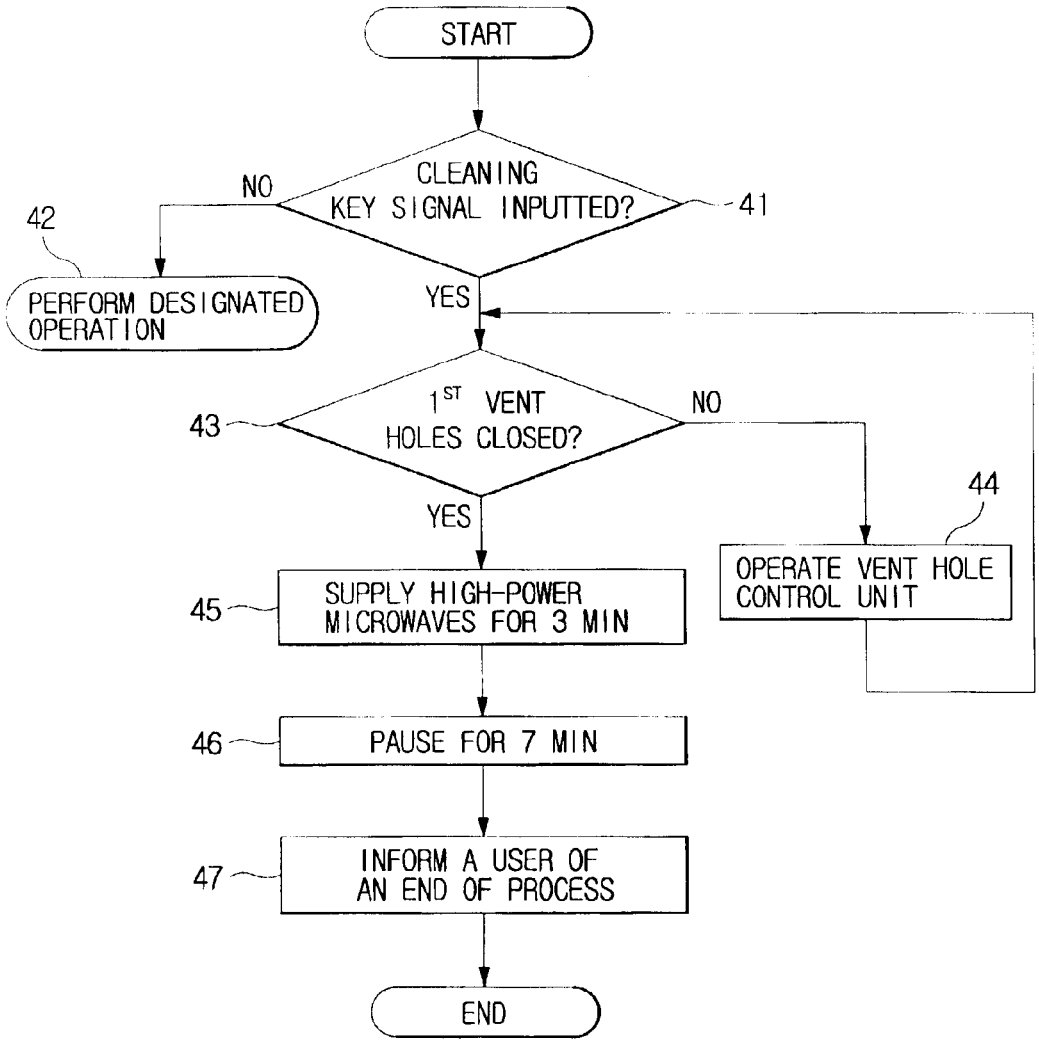
FIG. 5 is a flowchart illustrating a control method of cleaning the microwave oven shown in FIG. 1.

FIG. 5 shows a flowchart illustrating a control method of cleaning the cooking cavity of the microwave oven shown in FIG. 1.

Where a user desires to clean the interior of the cooking cavity 11, a predetermined amount of water is fed into the water collecting depression 25 formed on the bottom of the cooking cavity 11, as shown in FIGS. 1 and 3. Thereafter, the user closes a door 28 of the cooking cavity 11, and manipulates a cleaning key (not shown) provided on a control panel 29 of the microwave oven, so as to initiate a cleaning control operation to generate steam from the water contained in the water collecting depression 25.

Figure 4:
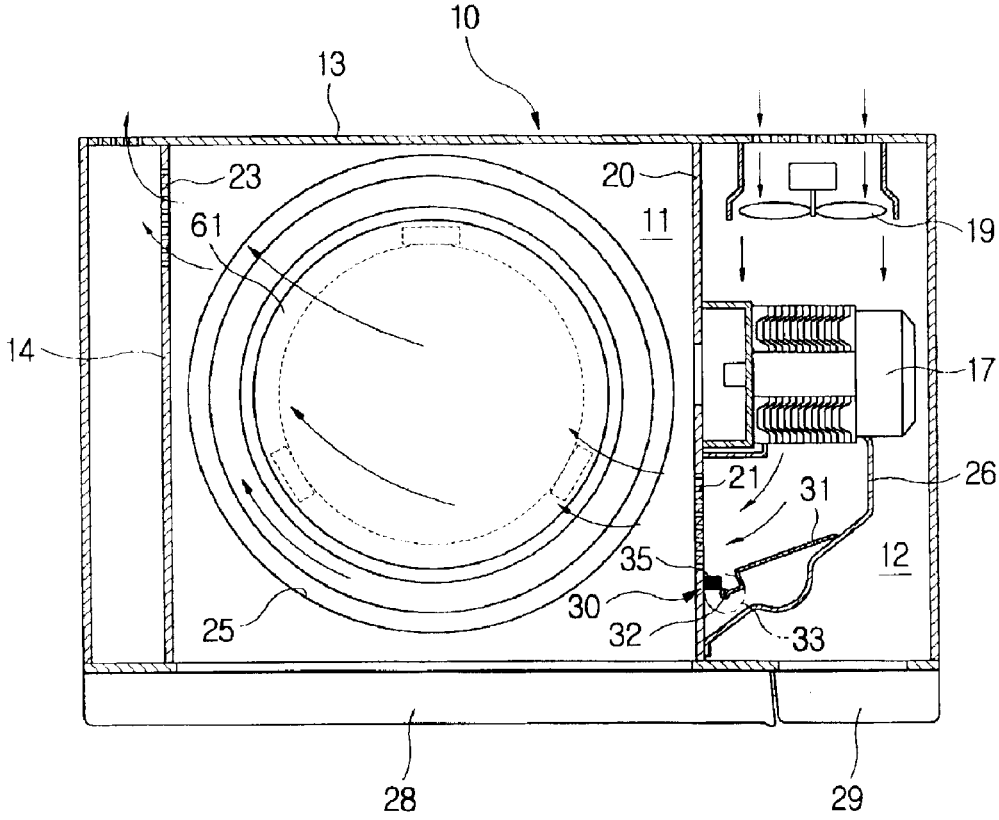
FIG. 4 is a sectional view taken along the line A–A' of FIG. 1, showing an open state of the first vent holes.

That is, in operation 41, a control unit of the microwave oven determines whether a cleaning key signal has been input from the cleaning key of the control panel 29. Where it is determined in the operation 41, that another key was manipulated, an operation corresponding to that key is carried out in operation 42. Where the cleaning key signal has been input in the operation 41, the control unit determines whether the first vent holes 21 have been closed in operation 43, using the vent hole sensor 35.

Where it is determined in the operation 43 that the first vent holes 21 have been maintained at an open state, as shown in FIG. 4, the vent hole control unit 30 is operated to close the first vent holes 21 in operation 44, as shown in FIG. 3. That is, in the operation 44, the cover 31 is rotated in a direction by the drive motor 33 to close the first vent holes 21. Where the first vent holes 21 are completely closed, the cover 31 comes into contact with the vent hole sensor 35, and the vent hole sensor 35 senses the closed state of the first vent holes 21.

Where the first vent holes 21 are completely closed, the magnetron 17 is operated in operation 45 at, for example, a high-power mode for about three minutes. High-power microwaves are thus irradiated from the magnetron 17 into the cooking cavity 11, and heat the water in the water collecting depression 25 to generate steam.

During the operation of the magnetron 17, both the cooling fan 19 inside the machine room 12 and the cooking tray 61 inside the cooking cavity 11 may be operated at the same time. Accordingly, the heated magnetron 17 is cooled by air sucked into the machine room 12 by the cooling fan 19, and the rotated cooking tray 61 disperses the microwaves inside the cooking cavity 11 to enhance the steam generation effect. While the steam is generated during the cleaning control operation, the lighting unit 50 may be turned on in the same manner as in a cooking operation, so as to light the interior of the cooking cavity 11 and allow the user to check the steam generating operation.

During the steam generating operation in which the magnetron 17 is operated to generate the steam, the first vent holes 21 are closed to minimize a leakage of the steam from the cooking cavity 11 to the outside of the microwave oven. Accordingly, it is possible to fill the cooking cavity 11 with a desired quantity of steam within a short period of time.

After a desired quantity of steam fills the cooking cavity 11, a pause is maintained in the cleaning control operation, for example, for about seven minutes, in operation 46, with the magnetron 17, cooling fan 19 and the cooking tray 61 being stopped. During the pause, the steam inside the cooking cavity 11 condenses into droplets on the interior surface of the cooking cavity 11. After the pause, the control unit informs the user of an end of the cleaning control operation through, for example, a display (not shown) of the control panel 29, in operation 47, thus allowing the user to easily clean the interior surface of the cooking cavity 11 that has been steam treated. In other words, steam inside the cooking cavity 11 condenses into droplets on the interior surface of the cooking cavity 11 during the pause, and wets and softens food pieces encrusted on the interior surface of the cooking cavity 11. Therefore, it is thus possible for the user to easily remove the wet and soft food pieces from the interior surface of the cooking cavity 11 by wiping the interior surface of the cooking cavity 11 after the end of the cleaning control operation.

Figure 6:
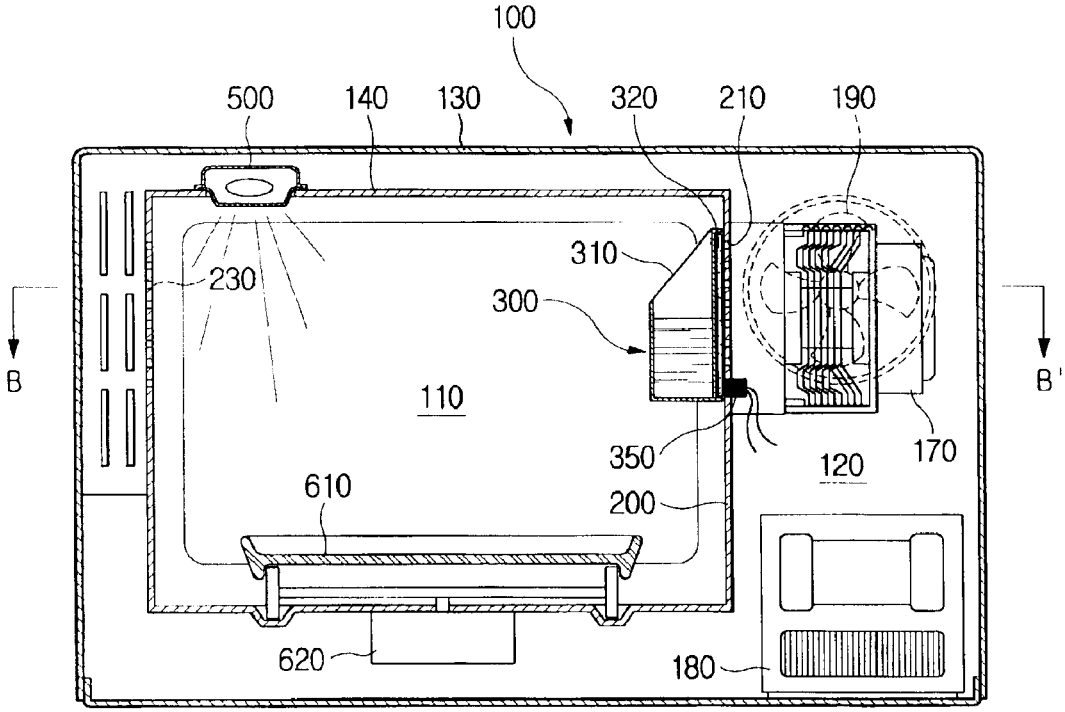
FIG. 6 is a sectional view of a microwave oven according to another embodiment of the present invention.
Figure 7:
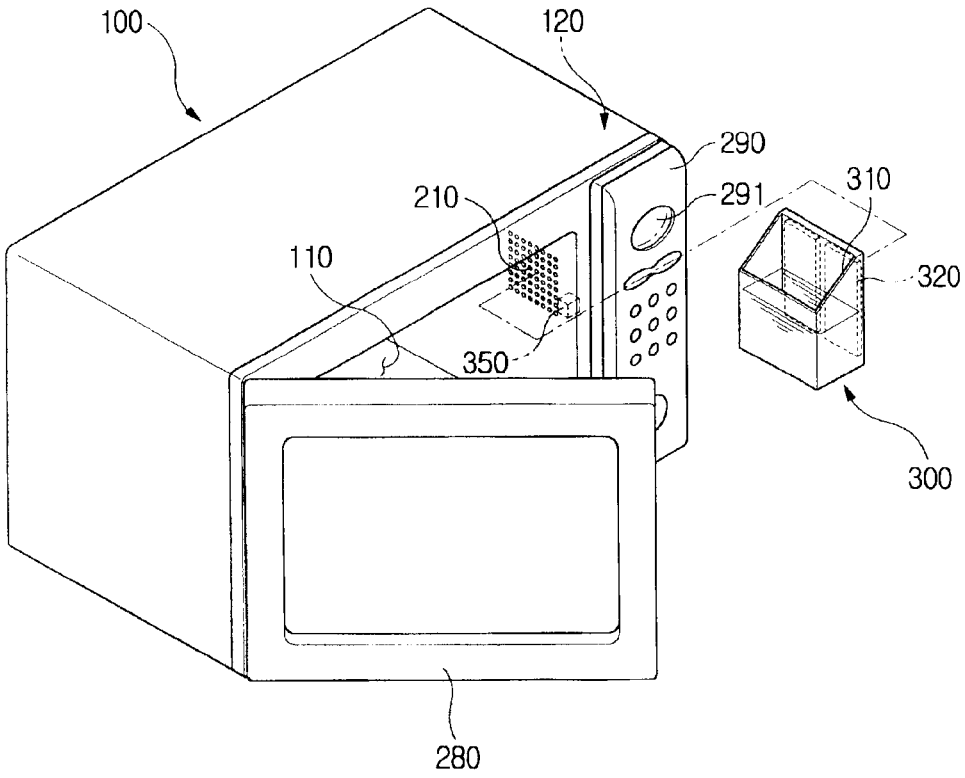
FIG. 7 is a perspective view illustrating a structure to mount a steam-generating vessel included in the microwave oven shown in FIG. 6.
Figure 8:
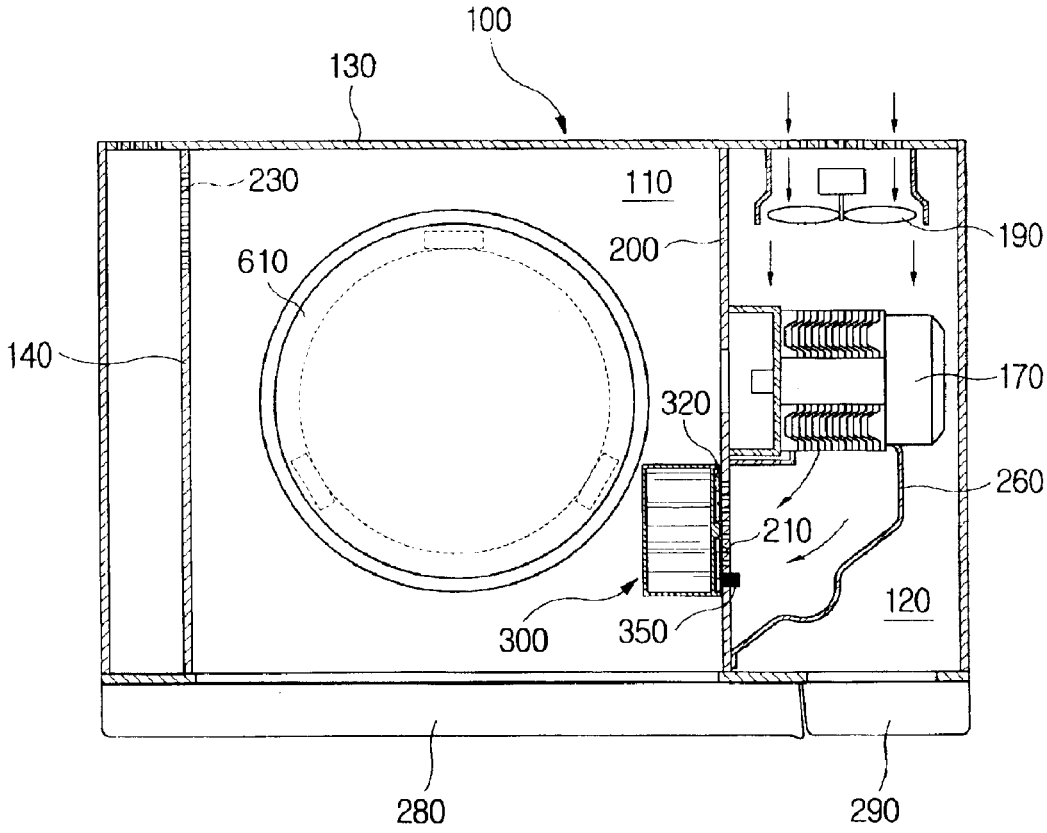
FIG. 8 is a sectional view taken along the line B–B' of FIG. 6.

FIGS. 6 to 8 show a microwave oven according to another embodiment of the present invention. As shown in the drawings, the microwave oven includes a body 100 having a cooking cavity 110 and a machine room 120 which are separately defined therein. The cooking cavity 110 receives food to be cooked therein and the machine room 120 receives a variety of electrical elements. An inner casing 140 of the microwave oven which defines the cooking cavity 110 is placed inside an outer casing 130 of the microwave oven, so as to divide an interior of the body 100 into the cooking cavity 110 and the machine room 120.

A cooking tray 610 is rotatably installed at a bottom of the cooking cavity 110, and supports food to be cooked by microwaves generated from a magnetron 170. A motor 620 is mounted at a position under the bottom of the cooking cavity 110, that is, a position under a bottom of the inner casing 140, and rotates the cooking tray 610. A lighting unit 500 is installed at an upper portion of the cooking cavity 110, and lights the interior of the cooking cavity 110 during, for example, a cooking operation.

As shown in FIGS. 6 and 8, the electrical elements installed in the machine room 120 include the magnetron 170 which irradiates the microwaves into the cooking cavity 110, and a high voltage transformer 180 which applies a high voltage to the magnetron 170. A cooling fan 190 is installed at a rear portion inside the machine room 120 so as to suck outside air into the machine room 120 to cool the electrical elements inside the machine room 120.

A sidewall 200 of the cooking cavity 110, which separates the cooking cavity 110 from the machine room 120, is provided with a plurality of first vent holes 210 to feed the air sucked into the machine room 120, using a suction force of the cooling fan 190, into the cooking cavity 110. A plurality of second vent holes 230 are formed at another sidewall of the cooking cavity 110, opposite to the sidewall having the first vent holes 210, so as to discharge the air from the cooking cavity 110 to the outside of the microwave oven. During an operation of the microwave oven, the outside air is sucked into the machine room 120 by the suction force of the cooling fan 190, thus cooling the electrical elements of the machine room 120. Thereafter, the air is introduced into the cooking cavity 110 through the first vent holes 210 to ventilate the cooking cavity 110, and discharged from the cooking cavity 110 to the outside through the second vent holes 230.

To allow further includes a cleaning device having a steam-generating vessel 300. The steam-generating vessel 300 is provided with a predetermined amount of water, and is mounted to the interior surface of the cooking cavity 110 to cover the entire first vent holes 210. As shown in FIG. 7, the steam-generating vessel 300 has a box-shaped body having a rectangular cross-section, and is open at a top thereof to receive the water therein. The steam-generating vessel 300 is made of, for example, a heat resistant resin which transmits the microwaves.

The open top 310 of the steam-generating vessel 300 is inclined at a predetermined angle of inclination. Accordingly, steam generated from the water contained in the steam-generating vessel 300 is smoothly and effectively dispersed into the interior of the cooking cavity 110, through the inclined open top 310.

The steam-generating vessel 300 has a surface area that is larger than an area of the entire first vent holes 210. Thus, the steam-generating vessel 300 completely covers and closes the first vent holes 210. In this embodiment, a magnet 320 is mounted to a rear wall of the steam-generating vessel 300, so as to easily attach or detach the steam-generating vessel 300 to or from the sidewall 200 of the cooking cavity 110 at the area of the first vent holes 210.

Figure 9:
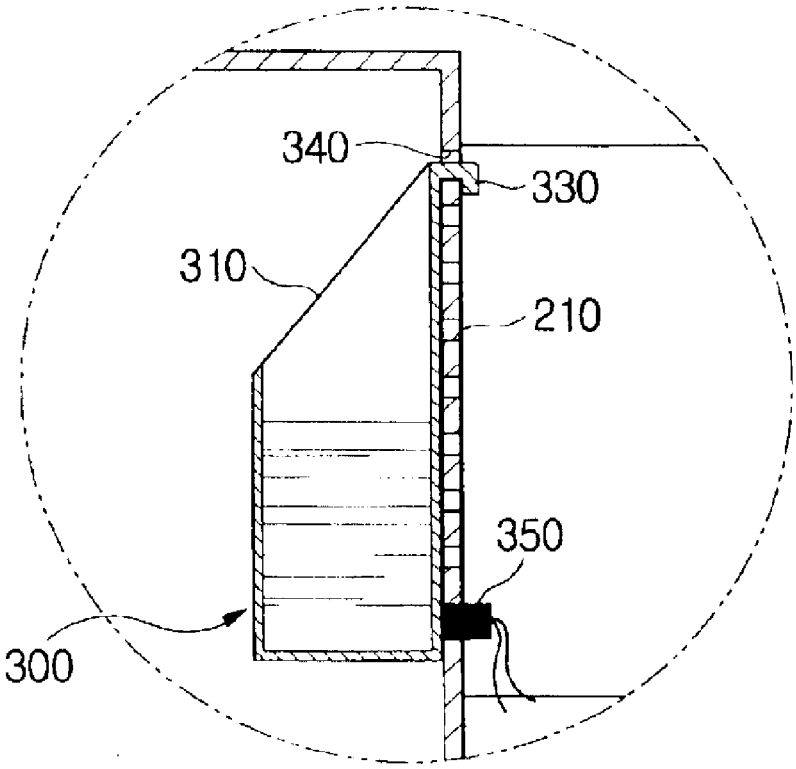
FIG. 9 is a perspective view illustrating another structure to mount the steam-generating vessel, according to a modification of the microwave oven shown in FIG. 6.

FIG. 9 shows a partial perspective view of a structure to mount the steam-generating vessel 300 to the sidewall 200, according to a modification of the embodiment shown in FIGS. 6 to 8. That is, a locking hook 330 is used instead of the magnet 320. The locking hook 330 extends rearward from an upper portion of a rear wall of the steam-generating vessel 300. A locking hole 340 is formed on the sidewall 200 of the cooking cavity 110 at a position above the first vent holes 210, and engages with the locking hook 330 to mount the steam-generating vessel 300.

In the microwave oven according to the FIGS. 6 to 9, a vent hole sensor 350 is provided on the sidewall 200 of the cooking cavity 110 at a position where the vent hole sensor 350 comes into contact with the steam-generating vessel 300. Accordingly, the vent hole sensor 350 senses an attachment of the steam-generating vessel 300 to the sidewall 200. The microwave oven may also include an alarm unit (not shown) which alerts a user where the vent hole sensor 350 senses an open state of the first vent holes 210, in which the steam-generating vessel 300 is not attached to the sidewall 200 of the cooking cavity 110, or inappropriately attached to the sidewall 200 so as to fail to completely close the first vent holes 210.

The vent hole sensor 350 may be realized through a micro-switch or an optical switch. The alarm unit may utilize a speaker capable of generating an audible signal, an LED capable of generating a visual alarm signal, or a display 291 provided on a control panel 290 of the microwave oven to alert the user where the vent hole sensor 350 senses an open state of the first vent holes 210.

Figure 10:
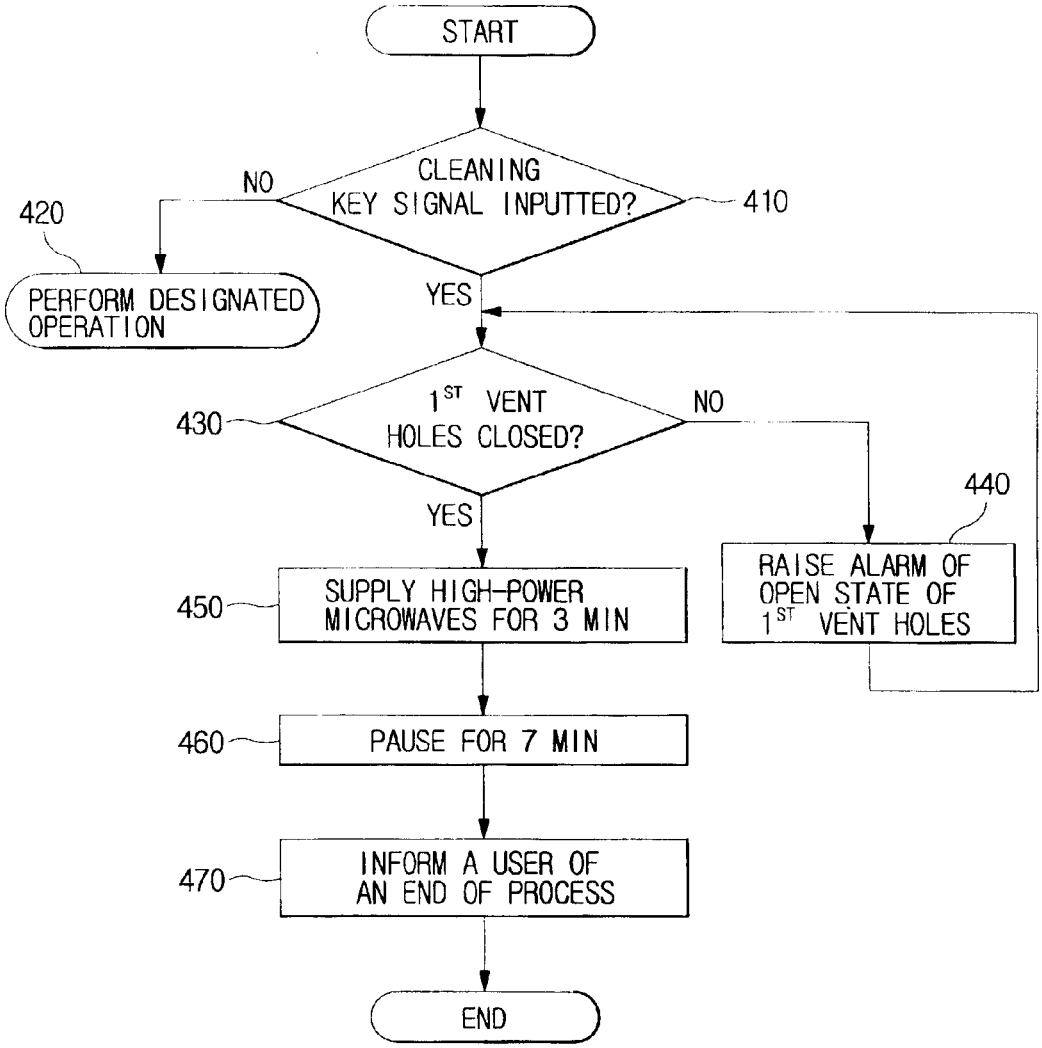
FIG. 10 is a flowchart illustrating a control method of cleaning the microwave oven shown in FIG. 6.

FIG. 10 shows a flowchart illustrating a control method of cleaning the cooking cavity of the microwave oven shown in FIGS. 6 to 9.

Where a user desires to clean the interior of the cooking cavity 110, a predetermined amount of water is fed into the steam-generating vessel 300, and the steam-generating vessel 300 is attached to the sidewall 200 of the cooking cavity 110 at an area corresponding to the first vent holes 210. In such a case, the steam-generating vessel 300 closes the entire first vent holes 210. Thereafter, the user closes a door 280 of the cooking cavity 110, and manipulates a cleaning key (not shown) provided on the control panel 290 of the microwave oven, so as to initiate a cleaning control operation to generate steam from the water contained in the steam-generating vessel 300.

That is, a control unit of the microwave oven determines whether a cleaning key signal has been input from the cleaning key of the control panel 290 in operation 410. Where it is determined in the operation 410 that another key was manipulated, an operation corresponding to that key is carried out in operation 420. Where the cleaning key signal has been input in the operation 410, the control unit determines whether the first vent holes 210 have been closed in operation 430, using the vent hole sensor 350.

Where it is determined in the operation 430 that the first vent holes 210 have been maintained at an open state (this means that the steam-generating unit 300 is not attached to the sidewall 200 of the cooking cavity 110 or is inappropriately attached to the sidewall 200 in such a way that the first vent holes 210 are not completely closed), the control unit raises an alarm through the alarm unit to inform the user of the open state of the first vent holes 210, in operation 440.

Where it is determined in the operation 430 that the first vent holes 210 are completely closed by the steam-generating vessel 300, the magnetron 170 is operated in, for example, a high-power mode for about three minutes, in operation 450. High-power microwaves are thus irradiated from the magnetron 170 into the cooking cavity 110, and heat the water in the steam-generating vessel 300 to generate steam.

During the operation of the magnetron 170, both the cooling fan 190 inside the machine room 120 and the cooking tray 610 inside the cooking cavity 110 may be operated at the same time. Accordingly, the heated magnetron 170 is cooled by air sucked into the machine room 120 by the cooling fan 190, and the rotated cooking tray 610 disperses the microwaves inside the cooking cavity 110 to enhance the steam generation effect.

While the steam is generated during the cleaning control operation, the lighting unit 500 may be turned on in the same manner as in a cooking operation, so as to light the interior of the cooking cavity 110 and allow the user to check the steam generating operation. During the steam generating operation in which the magnetron 170 is operated to generate the steam, the first vent holes 210 are closed to minimize a leakage of the steam from the cooking cavity 110 to the outside of the microwave oven. Accordingly, it is possible to fill the cooking cavity 110 with a desired quantity of steam within a short period of time.

After a desired quantity of steam fills the cooking cavity 110, a pause is maintained in the cleaning control operation, for example, for about seven minutes, in operation 460, with the magnetron 170, cooling fan 190 and the cooking tray 610 being stopped. During the pause, the steam inside the cooking cavity 110 condenses into droplets on the interior surface of the cooking cavity 110. After the pause, the control unit informs the user of an end of the cleaning control operation through the display 291 of the control panel 290, in operation 470, thus allowing the user to easily clean the interior surface of the cooking cavity 110 that has been steam treated. In other words, steam inside the cooking cavity 110 condenses into droplets on the interior surface of the cooking cavity 110 during the pause, and wets and softens food pieces encrusted on the interior surface of the cooking cavity 110. Therefore, it is possible for the user to easily remove the wet and soft food pieces from the interior surface of the cooking cavity 110 by wiping the interior surface of the cooking cavity 110 after the end of the cleaning control operation.

As described above, the present invention provides a microwave oven having a cleaning device, and a control method of cleaning an interior surface of a cooking cavity using the cleaning device. During a cleaning control operation, a magnetron of the microwave oven is utilized to heat water, which is fed into a water collecting depression formed on a bottom of the cooking cavity, or fed into a steam-generating vessel of the microwave oven, to generate steam. At this time, first vent holes formed on a sidewall of the cooking cavity are closed to minimize a leakage of the steam from the cooking cavity. Accordingly, it is possible to fill the cooking cavity with a desired quantity of steam within a short period of time, allowing a user to easily clean the interior of the steam treated cooking cavity.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a body which defines an appearance of the microwave oven;

a cooking cavity which is provided in the body;

a microwave-supplying unit which generates microwaves to irradiate the microwaves into the cooking cavity;

a vent hole which is formed on a wall of the cooking cavity to ventilate the cooking cavity;

a water collecting depression which is formed in a wall of the cooking cavity and which receives water therein to generate steam, the water collecting depression extending outwardly from an inside of the cooking cavity; and a vent hole control unit which closes the vent hole to control a leakage of the steam from the cooking cavity during an operation of the microwave-supplying unit.

2. The microwave oven according to claim 1, wherein the vent hole control unit comprises:

a cover which closes the vent hole and is provided at a position outside the cooking cavity;

a support shaft which rotatably supports the cover; and a drive motor which rotates the support shaft in opposite directions.

3. The microwave oven according to claim 2, further comprising a vent hole sensor which is provided at a position corresponding to the vent hole and senses whether the cover closed the vent holes.

4. The microwave oven according to claim 1, further comprising:

a machine room which is defined in the body, separately from the cooking cavity, wherein the microwave-supplying unit is provided in the machine room;

a cooling fan which is provided at a predetermined area of the machine room, cools the microwave-supplying unit and ventilates the cooking cavity.

5. The microwave oven according to claim 4, further comprising a cooking tray which is rotatably installed in the cooking cavity, wherein the cooling fan and the cooking tray are operated at the same time during a steam generating operation of the microwave oven so as to as to cool the microwave-supplying unit and disperse the microwaves inside the cooking cavity, respectively.

6. The microwave oven according to claim 1, wherein in response to a steam operation of the microwave oven, the microwave-supplying unit provides the microwaves to the cooking cavity to generate the steam from the water fed into the water collecting depression and the vent hole control unit closes the vent holes to reduce the leakage of the generated steam from the cooking cavity to the outside of the microwave oven.

7. The microwave oven according to claim 6, further comprising an alerting unit which provides one or more of an audible signal and a visual signal to indicate a completion of the steam operation.

8. The microwave oven according to claim 1, wherein the water collecting depression is formed on a bottom surface of the cooking cavity.

9. A microwave oven comprising:

a body which defines an appearance of the microwave oven;

a cooking cavity which is provided in the body;

a microwave-supplying unit which generates microwaves to irradiate the microwaves into the cooking cavity, and heats water fed into the cooking cavity to generate steam;

a vent hole which is formed on a wall of the cooking cavity to ventilate the cooking cavity; and a vent hole control unit which closes the vent hole to control a leakage of the steam from the cooking cavity during a steam cleaning operation of the microwave oven, wherein the vent hole control unit is detachably attached to cover the vent hole and includes a steam-generating vessel which receives the water.

10. The microwave oven according to claim 9, wherein the vent hole control unit comprises:

a cover which closes the vent hole and is provided at a position outside the cooking cavity;

a support shaft which rotatably supports the cover; and a drive motor which rotates the support shaft in opposite directions.

11. The microwave oven according to claim 9, further comprising a control unit which controls the steam cleaning operation of the microwave oven.

* * * * *

UNITED STATES PATENT AND TRADEMARK OFFICE

CERTIFICATE OF CORRECTION

PATENT NO. : 6,878,910 B2
DATED : April 12, 2005
INVENTOR(S) : Hyang-ki Kim et al.

It is certified that error appears in the above-identified patent and that said Letters Patent is hereby corrected as shown below:

Column 10,
Line 18, delete "as to" second occurrence.

Signed and Sealed this

Sixth Day of December, 2005

JON W. DUDAS
*Director of the United States Patent and Trademark Office*